United States Patent [19]

Peters et al.

[11] Patent Number: 4,943,060

[45] Date of Patent: Jul. 24, 1990

[54] LITTLE MINI SNOWMAN GAME

[76] Inventors: Duane Peters; Ty C. Peters, both of 2237 Terrace Dr., New Brighton, Minn. 55112

[21] Appl. No.: 316,777

[22] Filed: Feb. 28, 1989

[51] Int. Cl.[5] ..... A63B 63/00; A63B 43/00

[52] U.S. Cl. ..... 273/109; 273/112; 273/118 R; 273/127 R

[58] Field of Search ..... 273/109, 110, 118 R, 273/126 R, 127 R, 317, 338, 337, 112

[56] References Cited

U.S. PATENT DOCUMENTS

| | | | |
|---|---|---|---|
| 626,328 | 6/1899 | Kroscher et al. | 273/338 |
| 1,551,265 | 8/1925 | Perry | 273/109 |
| 4,032,141 | 6/1977 | Tanimura | 273/338 |
| 4,515,373 | 5/1985 | Hirshfeld | 273/317 |
| 4,720,107 | 1/1988 | Peters et al. | 273/109 |
| 4,772,240 | 9/1988 | Boskovic | 273/109 |

FOREIGN PATENT DOCUMENTS

| | | | |
|---|---|---|---|
| 673984 | 5/1950 | United Kingdom | 273/337 |

*Primary Examiner*—Randall L. Green
*Assistant Examiner*—Gary Jackson

[57] ABSTRACT

A hand-held miniature snowman game, or toy comprises a transparent see-through cover, and a solid-colored base, containing three different diameter white balls within and having a ramp for the balls to roll up on while unit is held in an upright position, and a singular stake for the balls to fall in sequence to create a minature snowman large ball to go on stake first then medium ball to go on second and smallest ball to go on stake last. There are three different versions, the only difference is the amount of holes in each of the white balls, also is a round rule disk mounted at the lower part of the unit. A game or toy for 5 year old children and on up to all ages including adults.

12 Claims, 4 Drawing Sheets

LITTLE MINI SNOWMAN GAME

BACKGROUND OF THE INVENTION (1) Field of the Invention:

This invention relates to (3) small white balls, one stake, one ramp, a see through cover and one solid-colored base. The present invention in its preferred form involves a twist of the wrist to allow one white ball at a time to roll up the ramp to make it operable. The invention is designed to be enclosed so that the white balls, stake, and the ramp will not be touched by human hands. Thus, the person handling the unit will not soil his hands and possibly his clothes, like the large balls of snow that are rolled up outside on the ground, to create a snowman.

(2) Description of the Prior Art

Real snowflakes are rolled together, weather permitting, and are commonly used for enjoyment outdoors. For example, when the large balls that are put together outdoors get too large, young children cannot stack them on top of each other to create a snowman.

About the time the children get a nice large snowman built, it will warm up and the snowman will melt leaving very disappointed children.

Often times children get a snowman half built, only to have other children come along and destroy it.

There are many places in the world without snow, so there is no way to build a snowman. Also, there is the problem of it being too cold in some places, so snow will not stick together in order to create the balls to make a snowman.

Due to injury and safety concerns, particularly when the balls become too large when stacked on top of each other to create a snowman, especially when there are small children present, there is always the chance that one of the top large balls will slide off and fall on a young

SUMMARY OF THE INVENTION

The present invention provides a see-through cover, for observing the small white balls with holes in them, and the small stake, and the ramp for the white balls to roll up on. A nice small case is provided to fit in one hand, and by repositioning it in all kinds of various directions, by the application of a little patience, and the right twist, and eye alignment in the right direction it can be a success.

According to the present invention there is provided a device useful for a lot of enjoyment, comprising three white balls, one stake, and one ramp, which make up the device. The stake may be molded in with part of the base, or may be a press fit, or have a threaded area where it would come up through the base, and also the ramp may be molded with the base, or be welded to the base, or mounted to the base with a couple of fasteners, which would be inserted up through the bottom of the base, and the ramp would have a couple of tapped holes in it for that purpose The base would have a couple of clearance holes in it for that purpose.

The device includes means for enclosing the white balls, stake, and ramp, the cover being a see-through cover.

A primary object of the invention is to provide children and adults the opportunity to stay in one location. Thus, the need for going out in the cold, wet weather to make a snowman is eliminated by the little mini snowman, which is made up of three small white balls, one stake, and one ramp, concealed in a small see-through, the cover which is secured to the base by a snap fit together, or it could be secured with three fasteners, and means to allow a complete rotation of the white balls with their holes in can roll up the ramp and proceed onto the stake to create a snowman.

The see-through cover and base positioned upside down enables the white balls to be freed from the stake.

Accordingly, the present invention provides for a hole or holes through the white balls thus enabling the stake to be rotated with respect such that the white balls roll up the ramp and with the right eye alignment will cause the white balls to fall down on the stake to create a snowman.

The primary object of the invention is to provide an educational toy, or puzzle, for children from approximately 6 years old to 12 years old. They can learn the difference between the diameters of the white balls, by first rolling the large ball up the ramp, then the medium sized ball up the ramp, and then the small ball up the ramp, but the balls must fall onto the stake in the correct sequence.

A further object of the invention is that a person from approximately 6 years old to all ages can create a mini snowman game, or puzzle, like four to eight children or adults sitting around a table, counter, or in a car or truck, can twist the device around and get the white balls, rolling up the ramp in order, can be played as a team, every other person is on the opposite team, as like the first player gets a white ball in place on the stake within the first three tries, then the player will proceed with three more tries, If the player doesn't make any more balls fall into place, the device is passed on to the next player, and that player will have three tries to put a white ball in place on the stake to complete the little mini snowman. The first player to complete the snowman with the third white ball to fall onto the stake and create the snowman is the winner, but if any one player tips the unit over and knocks a white ball off of the stake it is an automatic loss for their team. The other team automatically wins.

A still further object of the invention is that it is a nice game that can be played rain or shine, indoors or outdoors.

A still further object of the invention is that it is small and compact, and that everyone should have one or two in their glove compartment of each motor vehicle, as it would be a good pastime for everyone when taking a short or long trip with a vehicle, also one in each desk drawer at work.

Further objects of the invention will presently appear as the description proceeds in connection with the appended claims and the annexed drawings in which,

BRIEF DESCRIPTION OF THE DRAWINGS

Numeral references are used to designate like parts throughout the various figures of the drawings.

DESCRIPTION OF THE PREFERRED EMBODIMENTS

Figure 1:
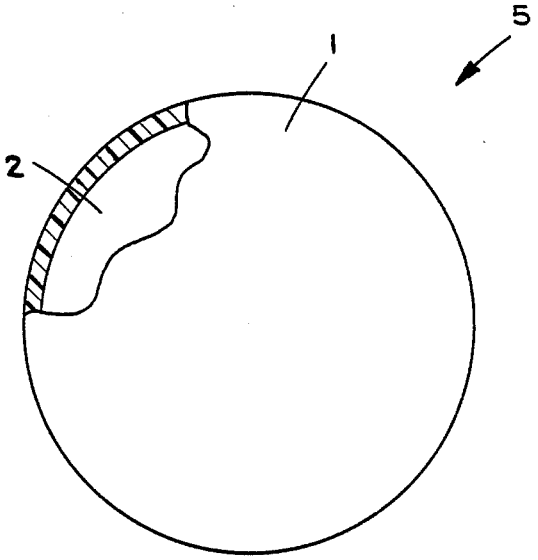
FIG. 1 is a top plan view of the little mini snowman game.

As shown in FIG. 1, in a preferred embodiment, little mini snowman game 5 of the present invention comprises a see-through cover 1, and comprises a solid-colored base 2, the cover 1 includes three detents 4 not shown, but cover 1 is a snap fit onto the base 2, where a notch is provided at the lower portion of the cover 1. Also at a lower stage of cover 1, are the three detents 4 to assure of a snap fit when cover 1 slides over base 2.

Figure 2:
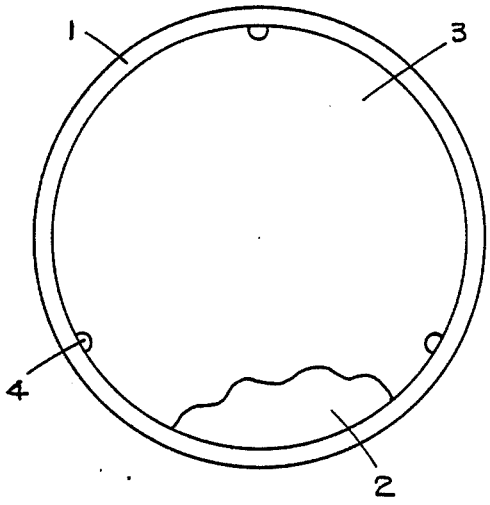
FIG. 2 is a bottom plan view of the little mini snowman game with the base, and disk snapped into the cover.

As shown in FIG. 2, a preferred embodiment, the present invention comprises one disk 3, for the purpose of lettering the rules of the game on. It will snap under base 2, and in between three detents 4, and a notch at the lower portion of the cover 1.

The base 2 is constructed and preferably is formed of plastic approximately 5/16 inch thick, and can be several different colors, like red, green, blue, or the material could be wood or other material, and approximately $2\frac{7}{8}$ inches in diameter, or could be hexagon, triangle, square or some other shape.

The disk 3 is constructed and preferably is formed of plastic approximately $\frac{7}{8}$ inch thick and red, green, blue, or brown in color, or could be made of wood or other material, and approximately $2\frac{7}{8}$ inches in diameter, or could be hexagon, triangle, square or some other shape. The cover is constructed and preferably is formed of clear plastic with a wall thickness of approximately $\frac{1}{8}$ inch, height of approximately $2\frac{3}{4}$ inches, and a diameter of approximately 3 inches. The cover could be hexagon, triangle, square or some other shape, as shown in FIG. 1, and in further detail in FIGS. 3, 7, and 11.

Figure 3:
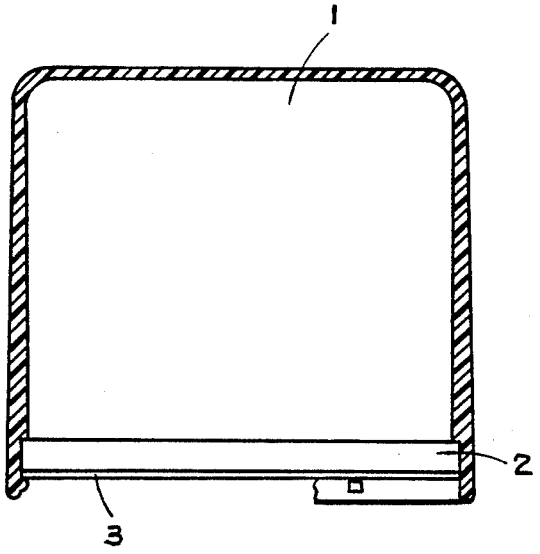
FIG. 3 is a front elevational view thereof; to illustrate how the base and disk snap into place just above the detents.

As shown in FIG. 3 in a preferred embodiment the cover 1 is secured to base 2 by a snap fit, also cover 1 is secured to disk 3 by a snap fit. Also, cover 1 could be secured to base 2 with some kind of adhesive. Also, disk 3 could be secured to base 2 with some kind of adhesive.

Figure 4:
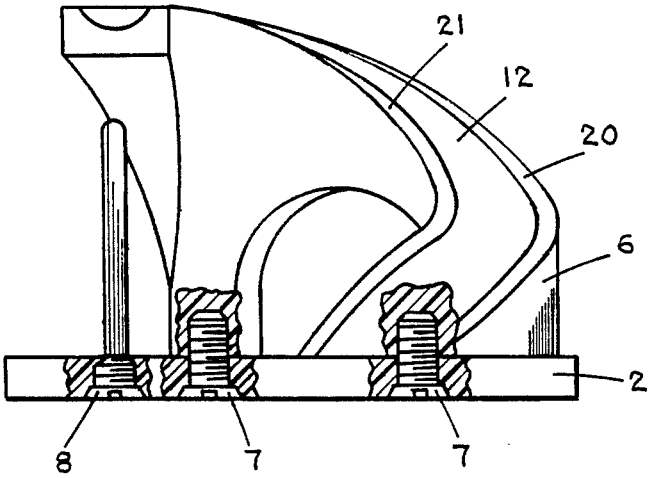
FIG. 4 is a front elevational view with the cover removed for clarity; showing 2 flat head screws mounting ramp onto base, also showing stake with threads at the lower portion of the stake, and flat head installed in the tapped hole in the base; also showing outer lip 20; also showing inner lip 21.

Referring to FIG. 4 comprises a base 2 having a ramp 6 perpendicular to the base 2, attached to the base 2, with two flat head screws 7, also ramp 6 could be secured to base 2 with some kind of adhesive. Also ramp 6 could be welded to base 2. Also stake 8 is mounted perpendicular to the base 2; it has a portion of threads at the lower end of the stake the same thickness as the base 2, and it also extends vertically above base 2, is approximately 1 7/16 inches, and the diameter of the stake portion above base 2, is approximately 3/32 of an inch, has a nice round radius at the top of the stake 8, not a shape point, just a dull point to accommodate the white balls when they roll off of the ramp 6. The end of ramp 6 where the white balls roll off is approximately $\frac{1}{2}$ inch above the end of stake 8, also stake 8 could be mounted to base 2, with some kind of adhesive. Also, stake 8 could be welded to base 2.

Figure 5:
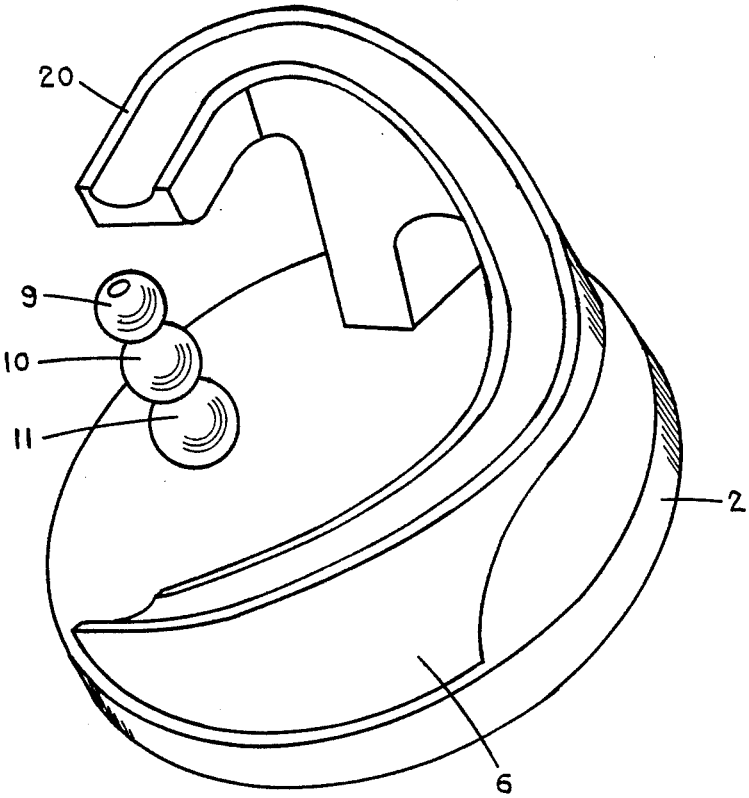
FIG. 5 is an enlarged perspective view of the unit with the cover removed to more clearly illustrate the ramp, base, and the 3 balls mounted on the stake to complete the little mini snowman.

Referring to FIG. 5 comprises a base 2, having a ramp 6 located in its respective position. Also, stake 8 is in its respective position, but not visible. Also comprises 3 white balls, are shown in their respective positions. Ball 11 is the largest one, ball 10 is the medium sized one, also the smallest ball 9.

Figure 6:
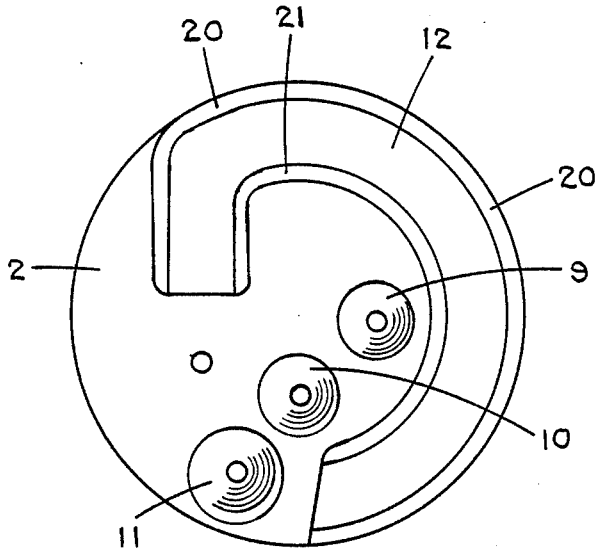
FIG. 6 is a top plan view of the base with the cover removed to more clearly illustrate the 3 balls laying on the base, also ramp and stake.

Referring to FIG. 6 comprises three white balls formed of plastic, ball 9 is $\frac{1}{2}$ inch diameter, ball 10 is 9/16 inch in diameter, ball 11 is $\frac{5}{8}$ inch in diameter. The white balls are lying on the base 2, same balls as shown in FIG. 5. Also shown is stake 8, and ramp 6. Also shown is a groove 12 which is part of ramp 6, from one end of ramp 6 to the other end of ramp 6 the groove 12 width remains the same.

Figure 7:
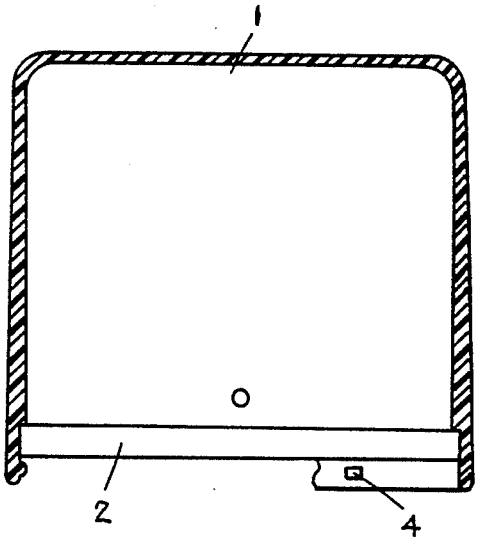
FIG. 7 is a front elevational view showing a sectional view of cover showing the base mounted in place.

Referring to FIG. 7 is showing a section of cover 1, also base 2 is in its respective position, also shown are 2 detents 4 which are formed in the cover 1.

Figure 8:
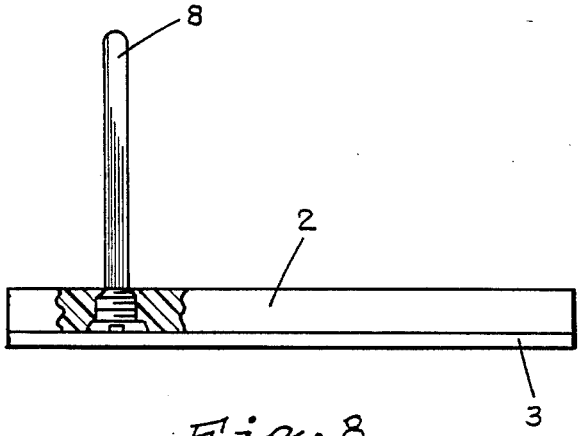
FIG. 8 is a front elevational view without the cover, showing a slotted flat head, threaded lower portion of the stake, mounted in the tapped hole in the base in a vertical position, also showing disk under the base.

Referring to FIG. 8 is showing base 2, and disk 3, also shoving stake 8, with a partial area broken away in base 2. It shows that the stake B is inserted through a tapped hole in base 2, and the tapped hole in base 2 is where the threaded part of stake 8 is tightened into base 2 to secure stake 8.

Figure 9:
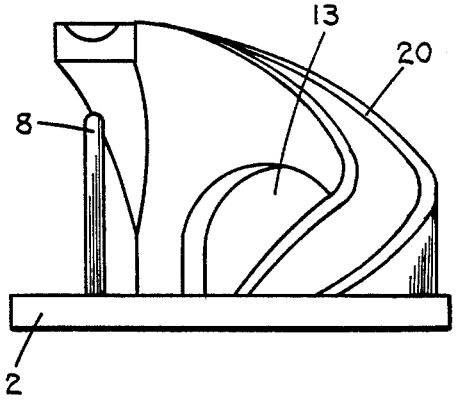
FIG. 9 is a front elevational view with the cover removed for clarity, and showing the stake in its position, also showing the ramp mounted in its position.

Referring to FIG. 9 is illustrating how the stake 8 extends above the base 2, also showing the ramp 6 in its respective position. Also comprises an open area 13 at the lower portion of ramp 6, so that when the large ball is on the stake 8, the other two balls will have enough area to move around the large ball when it is in its respective position on the stake 8, the other two balls will be able to move at an area of 360° around the ball that is in its respective position on the stake 8, without getting into a bind like between large ball and cover 1, or between large ball and any part of ramp 6.

Figure 10:
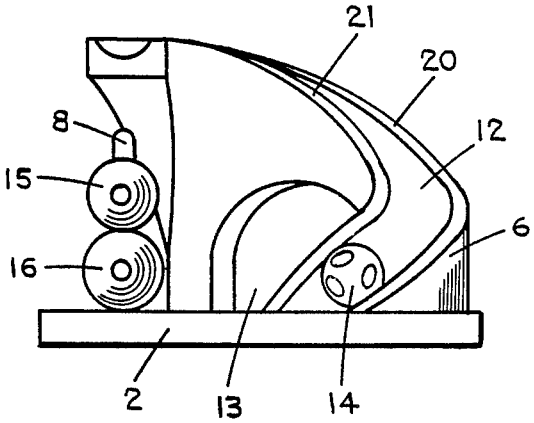
FIG. 10 is a front elevational view with the cover removed for clarity, and showing 2 balls in position on the stake, also showing the ramp in its position, and one ball just starting to roll up the ramp.

Referring to FIG. 10 shows three white balls formed of plastic, groove 12 on ramp 6; ball 14 is 178 inch diameter and is located in groove 12 at the bottom end of ramp 6. Ball 15 is 9/16 inch in diameter and it is in its respective position on stake 8. Also shown an open area 13 below ramp 6, and lips 20, 21 are along the edges of ramp 6.

Figure 11:
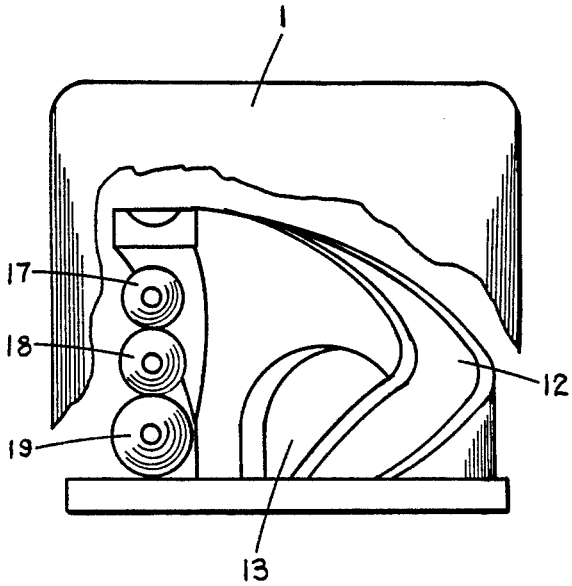
FIG. 11 is a front elevational view showing base and cover with parts broken away from cover to more clearly illustrate the details of construction, also showing 3 balls in position on the stake to show a complete little mini snowman, also showing the ramp in its position, also showing an open area of the ramp.

Referring to FIG. 11 comprises (3) white balls formed of plastic, ball 17 is $\frac{1}{2}$ inch diameter and is in its respective position on stake 8, ball 18 is 9/16 inch in diameter and it is in its respective position on stake 8. Also ball 19 is $\frac{5}{8}$inch in diameter and is in its respective position on stake 8. Also stake 8 is in its respective position, but not visible. A partial view of cover 1 is shown. Also shown is ramp 6 and an open area 13, under said ramp.

Figure 12:
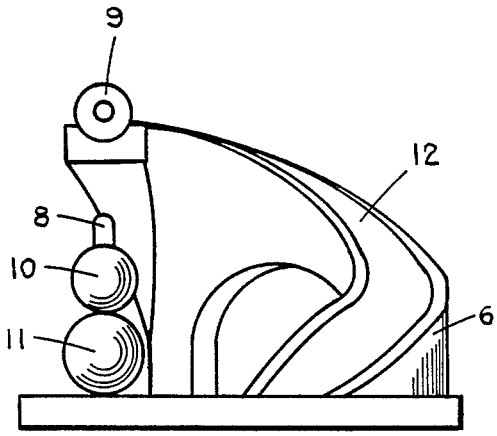
FIG. 12 is a front elevational view with the cover removed for clarity, and showing 2 balls in position on the stake, and the smallest ball is at the top of the ramp, just waiting to fall onto the stake, to complete the little mini snowman, so when the little mini showman is created in FIG. 12, there will be no exposed holes shown.

Referring to FIG. 12 is illustrating how the balls slip over the stake 8, ball 11 is in its respective position. Ball 10 is in its respective position. Ball 9 is in groove 12 and located at the top end of ramp 6. Also shown is base 2, with cover 1 not shown.

It is believed the foregoing description conveys a good understanding of the objects and advantages of my invention; the appended claims have been drawn to cover all legitimate modifications and adaptations.

What is claimed is:

1. A miniature snowman game apparatus comprising a substantially flat base having spaced apart top and bottom surfaces and a plurality of apertures extending through said surfaces; at least one stake means attached to said base such that said stake extend above said top surface through said apertures in said base; said stake being equal to the number of apertures; a ramp means attached to said top surface having an upwardly curved body; a plurality of game pieces having holes therethrough; and a see through cover means attached to said base adapted to enclose said ramp, game pieces and stake means.

2. The apparatus of claim 1, wherein said stake has a head portion and a lower threaded portion and said head being larger in diameter than said lower portion; said threaded portion is substantially equal to the distance between said top and bottom surfaces.

3. The apparatus of claim 1, wherein said holes in said game pieces are greater than said diameter of head portion and said pieces are adapted to slide on said stake.

4. The apparatus in claim 8, wherein said game pieces are balls.

5. The apparatus of claim 1, wherein a cover is mounted beneath said bottom surface to secure a disk having indicia to explain said rules.

6. The apparatus of claim 1, wherein there are three of said pieces of different diameters and said holes being chamfered to allow slidability on said stake,

7. The apparatus of claim 1, wherein said curved body has a radius of about 1.25 inches to 1.375 inches and provided with groove means to accommodate said pieces.

8. A game apparatus comprising three balls, a stake means and enclosed in a housing means; said stake is mounted to a base in said housing; said balls are $\frac{1}{2}$; 9/16, and $\frac{5}{8}$ inches in diameter with a plurality of $\frac{1}{8}$ inch diameter holes in each of said balls; each of said balls are adapted to slide over said stake; each of said $\frac{1}{8}$ inch diameter holes being chamfered to allow free sliding of said balls onto said stake to create a mini-snowman when said housing is manipulated.

9. The game apparatus of claim 8, wherein each of said balls have a top, bottom, front and back side, (a) each of said balls has $\frac{1}{8}$ inch diameter hole from center of top through to center of bottom;

(b) each of said ball has an $\frac{1}{8}$ inch diameter hole from center of front through to center of back;

(c) and each ball has an $\frac{1}{8}$ inch diameter hole from center of right side through to center of left side;

(d) all holes at each end have a chamber of 0.020 by 45 degree angle.

10. The apparatus of claim 8, wherein each of said balls have a top, bottom, front and back side, (a) each of said ball has an $\frac{1}{8}$ inch diameter hole from center of top through to center of bottom;

(b) and each of said ball has an $\frac{1}{8}$ inch diameter hole from center of front through to center of back;

(c) all holes at each end have a chamber of 0.020 by 45 degree angle.

11. The apparatus of claim 8, wherein each of said balls have a top, bottom, front and back side;

(a) the $\frac{1}{2}$ inch diameter ball has an $\frac{1}{8}$ inch diameter hole from center of top just half-way through to mid-center of ball, not completely through;

(b) the 9/16 and $\frac{5}{8}$ inch diameter balls, each have $\frac{1}{8}$ inch diameter holes from the center of top through to center of bottom;

(c) all visible holes at each end have a chamfer of 0.020 by 45 degree angle.

12. The apparatus of claim 8, wherein said cover includes; two $\frac{1}{8}$ inch diameter holes 180 degrees apart, up $\frac{1}{2}$ inch from bottom of said cover, for the purpose of condensation build up.

* * * * *